US005647690A

United States Patent [19]

Landau

[11] Patent Number: 5,647,690

[45] Date of Patent: Jul. 15, 1997

[54] LOW COST INSTALLATION OF COLUMNS OF MATERIAL

[76] Inventor: Richard Erwin Landau, 768 Springfield Ave. (B-6), Summit (Union County), N.J. 07901

[21] Appl. No.: 488,963

[22] Filed: Jun. 8, 1995

[51] Int. Cl.[6] ..... E02B 11/00

[52] U.S. Cl. ..... 405/50; 405/233

[58] Field of Search ..... 405/50, 233, 241; 175/20, 323, 171, 394

[56] References Cited

U.S. PATENT DOCUMENTS

| | | | |
|---|---|---|---|
| 3,228,200 | 1/1966 | Dufresne | 405/241 |
| 3,303,656 | 2/1967 | Landau | 405/50 |
| 3,426,538 | 2/1969 | Turzillo | 405/50 |
| 3,499,293 | 3/1970 | Kato | 405/241 |
| 3,512,366 | 5/1970 | Turzillo | 405/241 |
| 3,522,708 | 8/1970 | Fivman | 405/50 |
| 3,604,214 | 9/1971 | Turzillo | 405/241 |
| 3,690,109 | 9/1972 | Turzillo | 405/241 |
| 3,772,894 | 11/1973 | Godley et al. | 405/50 |
| 4,966,498 | 10/1990 | Blum | 175/171 X |
| 5,256,003 | 10/1993 | Ito et al. | 405/50 X |

*Primary Examiner*—Frank Tsay

[57] ABSTRACT

This apparatus includes a hopper large enough to hold material to fill a number of cavities which are backfilled to produce columns in soil by first advancing a hollow shaft attached to the hopper into the soil and flowing sand from the hopper through the shaft and into the cavity formed as the shaft is withdrawn. The material flowing from the hopper through the shaft is stopped after each column is filled by closing a valve in its flow path. The equipment is moved to the next location in the area point without having to fill the hopper, which saves time and avoids waste of material. When sand is the material, the hopper is pressurized to cause the sand to flow, as in the installation of sand drains used in making wet soils safe for the support of construction.

11 Claims, 2 Drawing Sheets

LOW COST INSTALLATION OF COLUMNS OF MATERIAL

BACKGROUND OF THE INVENTION

This invention relates to an improvement in methods and equipment to install columns of granular material in soil formations containing substantial quantities of water or other fluids to expedite the dissipation of water or fluid pressures induced by applied loads and stresses in order to expedite soil settlement and to render soil more stable and improve its capacity to safely support construction.

More particularly, this invention relates to an improvement in available methods and equipment to permit the installation of sand drains with diameters as small as 2" or less, heretofore considered uneconomic, in order to compete with small band shaped "wick drains" which are effectively replacing the use of sand drains.

DESCRIPTION OF THE PRIOR ART

Sand drains specified by engineers have in the past ranged from 6" to 24" in diameter. For about the last 30 years specified sand drains range from 12" to 18" in diameter, with those installed by methods and equipment disclosed in U.S. Pat. No. 3,303,656 limited to sand drains 18" in diameter.

The term "wick" refers to a prefabricated band shaped drain which often is a geotextile fabric sleeve covering on a grooved plastic core about 4" wide and ⅛" thick. The geotextile restrains passage of soil particles while permitting the transverse passage of water to the core along which water flows longitudinally to areas of lower pressure. Wicks in use today are supplied in rolls up to 1000' long, and its installation involves passing the wick from the roll to the top of a hollow bore shaft often, termed mandrel, positioned vertically and threaded downward within the mandrel to its penetrating end where it is anchored to a steel plate and held by the wick in preparation for insertion into the soil. The advance of the mandrel into the soil pushes the anchor plate which in turn pulls the wick. Wick material is pulled from the roll when the mandrel is extracted as the wick in the soil is left in place being anchored by the anchor plate at the depth to which it had been advanced. The fully extracted mandrel exposes a length of the continuous wick above the ground surface, where the wick is cut to leave the portion in the soil as the required drain. A new anchor plate is attached to the portion of the wick left extended from the mandrel and wick installation is repeated. The low cost of wick drains relects its rapid installation by relatively light weight equipment, the fact that two men are involved in installation, and little or no material is wasted.

Theory applied to the design of columnar drain systems is based on a circular drain. Because wicks are band shaped, experience and research suggests that a 4"×¼" wick is approximately equivalent to a 2" diameter sand drain. However, wick drains do not perform as well as equivalent size sand drains by virtue of the fact that wicks are installed by advancing a mandrel which leaves displaced and remolded soil around the periphery of the wick after the mandrel is extracted.

Although not anticipated by engineers familiar in the art, it has been determined that in addition to remolding the soil adjacent to the wick the small mandrel with only about a 10 square inch cross-section used in wick installation induces water pressure in soil adjacent to the wick to an extent which retards the flow of water from surrounding soil and inhibits dissipation of pressures induced by construction as well as natural causes, such as earthquakes. The effects of remolding related to mandrel use are described in U.S. Pat. No. 3,096,622.

The development of a practical and economical method to install 2" diameter sand drains has hertetofore been considered unfeasible in view of the fact that sand drains, which have been installed by preferred methods decribed in U.S. Pat. No. 3,096,622 have not been less than 12" in diameter, and that only 18" diameter sand drains have been installed by methods and equipment disclosed in U.S. Pat. No. 3,303,656.

Sand drains that were installed by augering in accordance with U.S. Pat. No. 3,303,656 involved a 4' hopper in diameter and 10' to 20' or so long depending on the length of the drain which usually extended from about 10' to 90' below ground. The hopper is filled with sand through an access port which is then closed and the hopper is pressurized to effect the flow of columnar material through the hollow shaft of the auger to fill the cavity formed as the auger is withdrawn from the soil. Sidewalls of cavities formed for granular column installation may collapse if left unsupported during the backfill process, which is one of the reasons that fluid pressure is applied when the cavity is being filled. As sand placed in the hopper is loose and densifies to varying degrees under its own weight in the cavity, the volume placed in the hopper is normally 25% more than the volume needed to fill the cavity formed in soil with auger withdrawal, after which hopper pressure and excess sand in the system is lost.

Experience in using this apparatus for 18" diameter columns indicates that it takes about 4 minutes to fill and pressurize the hopper for 20' long sand drains and about 8 minutes for 90' long drains, with cycle times being about 8 minutes and 30 minutes respectively, or 3 about minutes per foot of sand drain. In contrast to this, the cycle time for wick drain installation is about 2 seconds per foot, with little waste involved.

SUMMARY OF THE INVENTION

It is the object of this invention to reduce the cost of granular drain installation by reconfiguring the equipment disclosed in U.S. Pat. No. 3,303,656 to permit the installation of multiple drains using the hopper configuration and at the same time avoiding the pressure and granular material loss related to the removal of the hollow shaft from the soil after the cavity is filled.

A further object of this invention is to reduce the cost of granular drain installation by reconfiguring the equipment disclosed in U.S. Pat. No. 3,303,656 to enable the movable cap that can pivot or displace to be returned to its fixed position with minimum loss of material and pressure from the hopper or system.

BRIEF DESCRIPTION OF THE DRAWINGS

The present invention will be more fully understood by references to the following detailed description thereof when read in conjunction with the attached drawings, wherein.

DETAILED DESCRIPTION OF THE DRAWINGS

Figure 1:
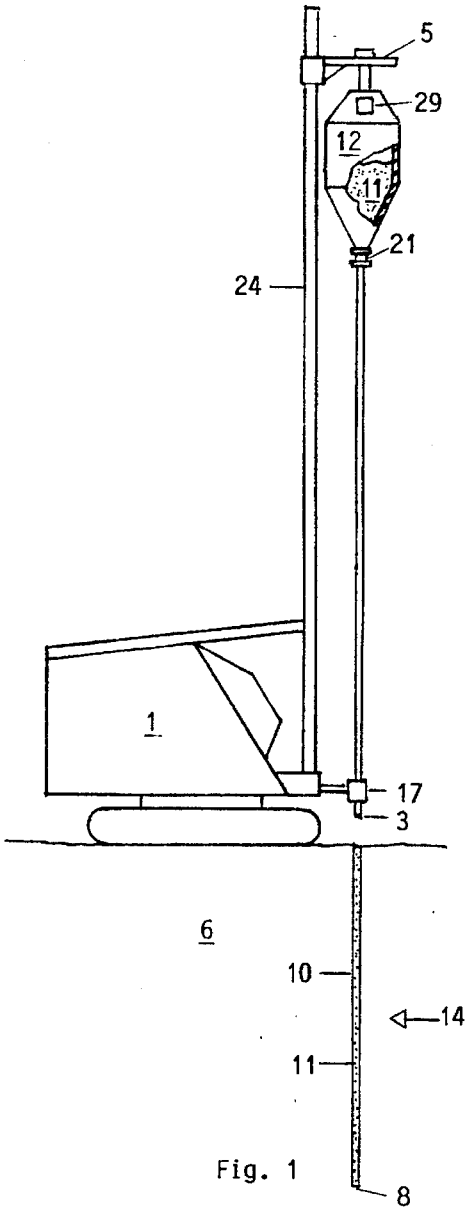
FIG. 1 is a sectional view of the embodiment of the present invention which utilizes a hollow shaft (mandrel) to install sand drains.

The embodiment of the invention in FIG. 1 incorporates unit 1 which supports carriage 5 in travelling along track 24 on unit 1. Carriage 5 supports and aligns hopper 12 and elongated hollow shaft (mandrel) 23, which travel in conjunction with carriage 5 toward and away from soil 6 in the column forming process. Guide 17 at the lower end of unit 1 may be used to maintain the alignment of mandrel 23. To prevent intrusion of soil, cap 3 at the penetration end of mandrel 23 is closed in the manner of a check valve during the advance into soil 6 to depth 8. The gravitational weight of mandrel 23 hopper 12 and other elements moving with carriage 5, as well as other forces applied when necessary, serve to advance mandrel 23 into the soil 6. After the interior of hopper 12 is filled through port 29 it is closed and pressurized and with cap 3 and valve 21 open to form a continuous flow path, material 11 is flowed from hopper 12 through the hollow of the conjoined hollow shaft 23 to fill cavity 10 formed with the withdrawal of mandrel 23 to form column 14. Valve 21 is closed after cavity 10 is filled with columnar material 11. Cap 3 is positioned to close mandrel 23 at the start of a subsequent column forming cycle. The cross-section of column 14 is expected to relect the shape of mandrel 23.

Figure 2:
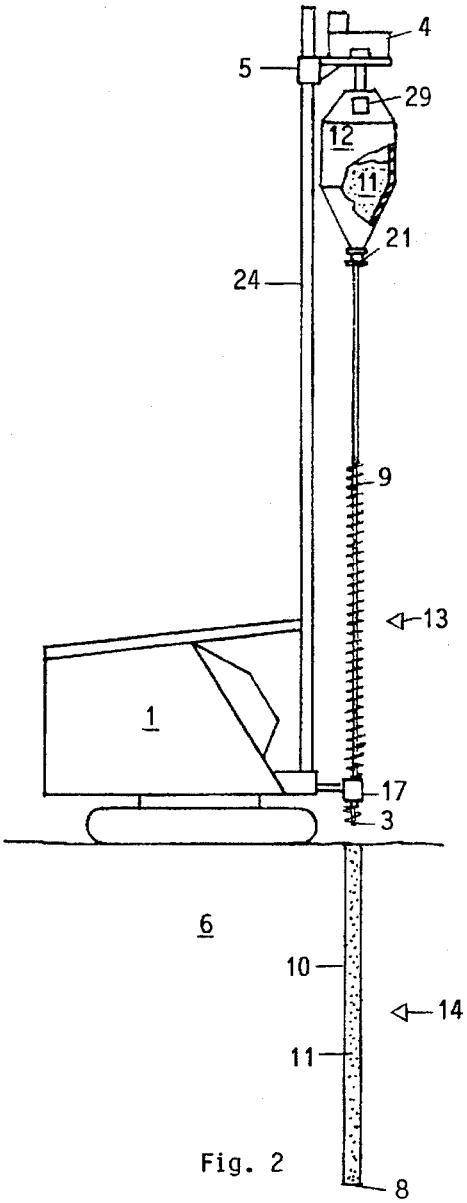
FIG. 2 is a sectional view of an embodiment of the present invention using a hollow shaft flight auger which is expected to produce drains which will perform more effectively than those installed by mandrel.

The embodiment of the invention in FIG. 2 incorporates unit 1 which supports carriage 5 in travelling along track 24 on unit 1. Carriage 5 supports and aligns hopper 12 and conjoined hollow shaft 23 to which flights 9 are fixed to form auger 13. Hopper 12 and auger 13 travel in conjunction with carriage 5 toward and away from soil 6 in the column forming process. Guide 17 at the lower end of unit 1 may be used to maintain the alignment of auger 13. With cap 3 at the penetration end of auger 33 in its closed position to prevent the intrusion of soil into hollow shaft 23, drive 4 supported on carriage 5 rotates hopper 12 and conjoined auger 13 to helically penetrate auger 13 into soil 6 to depth 8. Hopper 12 is filled through 29, port 29 is closed, hopper 12 is pressurized, cap 3 and valve 21 are opened to form a continuous flow path, material 11 is flowed from hopper 12 through conjoined hollow shaft 23 to fill cavity 10 formed with the withdrawal of auger 13 to form column 14. Valve 21 is closed when cavity 10 is filled with columnar material 11. Cap 3 closes hollow shaft 23 at the start of a subsequent column forming cycle. The cross-section of column 14 reflects the outer dimension of flights 9 of auger 13. Where soil 6 is very soft, unit 1 may apply a resisting force on carriage 5 to constrain the weight of hollow shaft 23 hopper 12 and other elements moving with carriage 5 for flights 9 to helically penetrate into soil 6. When soil 6 contains hazardous substance its excavation is avoided during auger 13 penetration into soil 6 by advancing auger 13 through the surface of soil 6 at a rate of not less than one pitch length of flights 9 per revolution of auger 13, and hazardous soil 6 within flights 9 is removed as the auger 13 withdraws from soil 6 by environmentally acceptable means for treatment at the site or disposal elsewhere.

Elements disclosed in U.S. Pat. No. 3,303,656 which may be applied to the present invention may not be shown in FIG. 1 and FIG. 2 as these are available to those familiar in the art.

This invention may be applied to form columns of other material for which pressurization may be discretionary when the columnar material 11 is fluidic and flows freely under its own weight.

Figure 3:
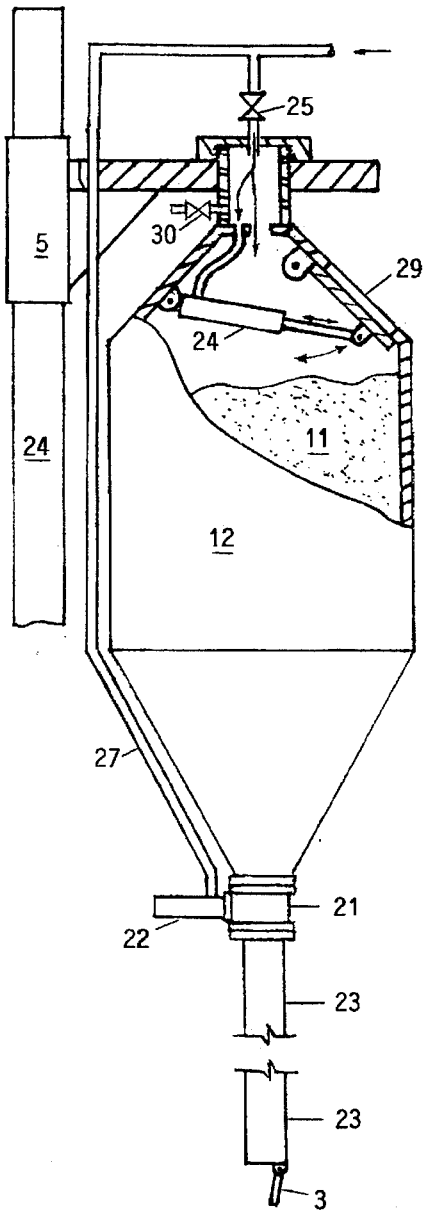
FIG. 3 is a typical application of a valve in the flow path to control the flow of sand filling the cavity formed in soil.

FIG. 3 shows valve 21 positioned in the vicinity of the flow path below hopper 12, with valve 21 being fully open or fully closed as operated by jack 22. Jack 22 is single acting with a spring return with valve 21 normally closed when no pressure is applied to jack 22. The fluid pressure activating jack 22 is the same fluid from pressure source 28, pressurizing hopper 12 and jack 24 which closes port 29 of hopper 12. A check valve 25 is provided in fluid pressure line 26, with pressure line 27 for jack 22 connected to line 26 ahead of check valve 25. Pressure applied in line 26 passes through check valve 25 pressurizes or restores pressure in hopper 12 and activates jack 24 to close or maintain closure of port 29, and jack 22 opens valve 21 to clear the flow path for fill material 11 in hopper 12 to flow through the system. With mandrel 23 withdrawn sufficiently to assure column formation, columnar material 11 is halted by releasing pressure in line 27 through line 26 at its source 28 causing jack 22 to retract closing valve 21 to prevent loss of pressure and material from the hopper.

Figure 4:
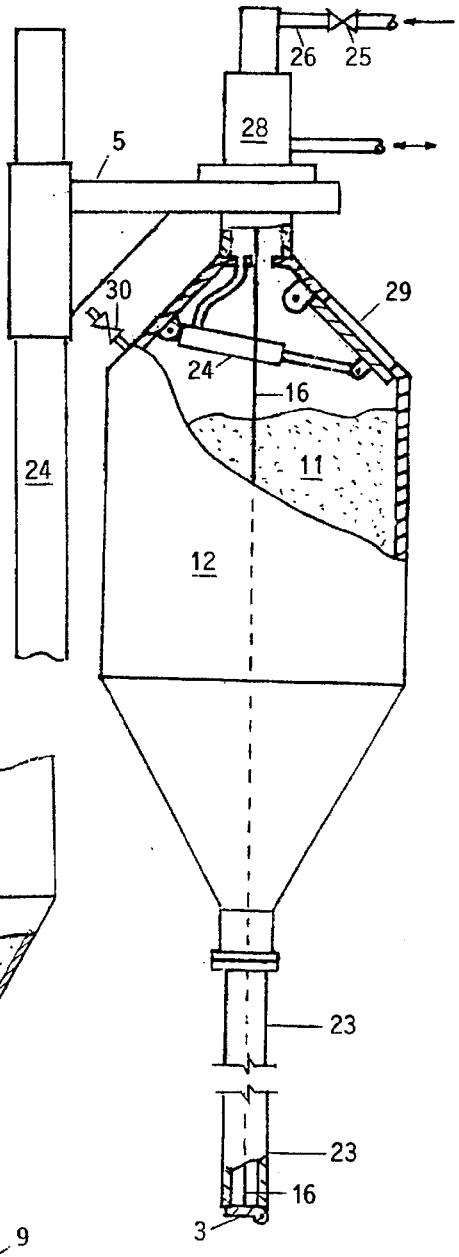
FIG. 4 shows a means to reposition the cap to prevent intrusion of soil at the penetration end of the hollow shaft, which may also serve as a valve.

FIG. 4 illustrates the operation of one form of movable cap 3 used to close the penetration end of mandrel 23 in FIG. 1, which is also the hollow shaft in FIG. 2. In this instance cap 3 is hinged to mandrel 23, jack 22, which is single acting with a spring return, connects to cap 3 by cable 16 with cap 3 normally open when jack 22 is spring retracted. When pressure is applied to jack 22 through pressure line 27, cable 16 is pulled to close valve 21 to stop flow from occurring at the same time cap 3 moves to close the end of mandrel 23 to prevent the intrusion of soil 6 during penetration. When pressure to jack 22 is relieved, the spring return retracts jack 22 and cap 3 pivots to its open position allowing columnar material 11 to flow into formed cavity 10 to form column 14. Where cap 3 may need to be pushed open cable 16 is replaced by rigid linkage.

Figure 5:
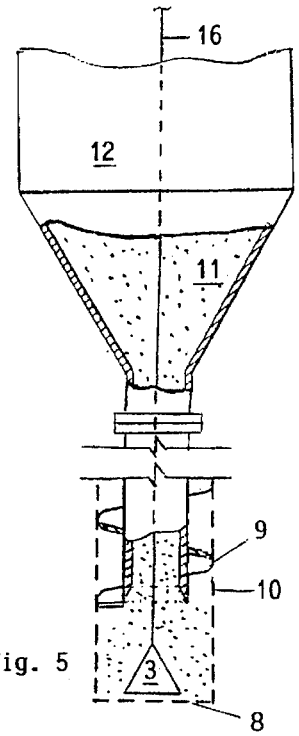
FIG. 5 is another form of cap that may be used at the penetration end of the hollow shaft.

FIG. 5 illustrates a different form of cap 3, which operates in the same fashion as described in FIG. 4 except that cap 3 is not hinged, and the configuration is suitable for use with the auger 13 in FIG. 2.

When hopper 12 needs to be refilled, the system may be depressurized by opening valve 30 in hopper 12. Details of piping and elements that may or may not be shown as these will be evident to those familiar in the art. The flow controls shown in the figures are only for illustration and should not be construed as limiting the types, configurations, and locations that might be used or controls related to such use.

In the embodiment of FIG. 1, cap 3 must be smaller than the outer dimension of mandrel 23 in order for it to open freely within the dimension of formed cavity 10, and is best designed to be fitted to seat at the inside of mandrel 23. Although the rate of flow of material 11 through mandrel 23 may be affected, it may be desirable to taper the outlet of mandrel 23 to reduce the size of the cap. Valve 21 may be configured to prevent intrusion of soil 6, in which instance it may be positioned at the penetration end of hollow shaft 23 or mandrel 23 to control flow and replace cap 3. When valve 21 replaces cap 3, valve 21 can be actuated by jack 22 in FIG. 4, with cap 3 in FIG. 4 and FIG. 5 reflecting two of various forms valve 21 may take.

Circular shaped drains are likely to perform more closely to design expectations. As such, hoppers used for 90' long 18" diameter sand drains, when modified in accordance with the present invention, will permit forming eighty 2" diameter sand drains, the effective size of 4" band shaped wicks, or twenty 4" diameter drains, etc. before column forming material needs to be added to the hopper. For 2" diameter drains 90' long, the prorated time to fill the hopper is estimated as 6 seconds per drain, which reflects a time saving of about 3 minutes or more as compared to filling the hopper after each column is completed, and waste of material 11 is also eliminated.

Variations in methods, embodiments and equipment described and illustrated will be evident to those familiar in the art without deviating from the teachings presented in this disclosure.

I claim:

1. An apparatus to reduce the time and cost of installing columns of material in soil by combining a cavity forming apparatus to install single columns with a valve means to restrain flow and pressure loss along a path from a pressurized hopper initially containing a quantity of said material to form more than one of said columns before replenishing said hopper material, comprising: a hopper to contain material interiorly to form at least two columns; means to enter said material into said hopper; means to provide fluid pressure to pressurize said hopper and said material; an outlet for flow of said material and said fluid from said hopper; an elongated shaft or mandrel with a hollow bore extended through and exposed at each end of said shaft; means mounting one end of said shaft conjointly with said hopper outlet to form a flow path extending through said hollow bore to a soil penetration end of said shaft; a controllable valve means along said flow path to control flow of said fluid and material through said flow path; a movable cap means at said shaft soil penetration end to close said hollow bore to prevent intrusion of said soil into said hollow bore of said shaft; means penetrating said shaft into said soil with said hollow bore closed at said penetration end causing said soil to displace to define a cavity to the depth of column formation in said soil; means withdrawing said shaft from said soil to form said cavity; means to cause said cap to open said hollow bore at said penetration end to expose said flow path through said shaft to a formed cavity; means to open said valve to flow said material and said fluid through said flow path into said cavity to complete said column to said cavity depth in said soil; means to close said valve to restrain flow of said material and said fluid on completing a first column; means moving said apparatus to locate and form at least a second cavity column with said apparatus, said valve means interrupting said flow path until flow of said fluid and said material to fill said second cavity to form at least said second column in said soil in the manner described for said first column.

2. The apparatus as defined in claim 1 wherein said moveable means located at the penetrating end of said hollow shaft to prevent intrusion of soil into said hollow shaft is connected to a control means which has an actuating system extending to a point remote from said penetrating end, which actuator returns said movable means from an open position to close the hollow shaft to prevent intrusion of said soil into said hollow shaft.

3. The apparatus as defined in claim 1 wherein said moveable cap means at the penetrating end of said hollow shaft is connected to a control means extending to a point remote from said penetrating end to close said hollow shaft to prevent intrusion of said soil into said hollow shaft during penetration into said soil and to open said hollow shaft to permit flow of said material into said cavity formed on withdrawal of said shaft.

4. The apparatus of claim 1 wherein said material is sand used to form sand drains to expedite settlement of compressible soils.

5. The apparatus of claim 1 wherein said shaft or mandrel cavity forming tool has one or more flights and/or vanes extending outwardly for at least a portion of said shaft and incorporating means to penetrate said cavity forming tool into said soil at least in part by rotating said shaft to a desired depth in said soil.

6. The apparatus of claim 5 wherein said flights or vanes are substantially continuous along said shaft and soil supported within said flights or vanes is removed from said soil as said shaft is withdrawn so as to contribute to the formation of said cavity in said soil into which said columnar material is flowed to complete said column.

7. Apparatus of claim 1 wherein said valve is positioned at the penetration end of said hollow shaft to control said flow and to replace said movable cap means to prevent intrusion of said soil during the advance of said hollow shaft through said soil.

8. The apparatus as defined in claim 1 wherein said movable cap means at the penetrating end of said hollow shaft closes at least in part as a result of the resisting force of said soil reacting to the force causing said hollow shaft to enter into and penetrate through said soil.

9. The method of installing a plurality of columns of material in soil by means of a hollow shaft cavity forming apparatus, the soil penetrating end of said hollow shaft having a movable cap with a fluid pressurized closed hopper containing a quantity of material to form at least two columns mounted conjointly at the upper end of said hollow shaft, with a valve means closed to prevent flow of material through the flow path from the hopper through the hollow shaft to avoid loss of pressure and flow of said columnar material, comprising the steps of:

(1) position said apparatus on the surface of soil where a first column cavity is to be formed;

(2) penetrate said soil and subsurface soil to the desired depth with said hollow shaft with said movable cap at the penetration end of said hollow shaft closed to displace said soil and define said first column cavity;

(3) withdraw said shaft from said soil to thereby form said first column cavity in said soil as said shaft withdrawal is progressed;

(4) cause said cap and flow path valve to open to expose said flow path from the hopper through the said hollow shaft into said first column cavity as said shaft withdrawal is progressed;

(5) fill said cavity to form said first column by flowing material from said fluid pressurized hopper into said cavity along said flow path;

(6) at the completion of said first column activate said valve means along said flow path to curtail or otherwise stop the flow of said pressurized fluid and material from said hopper;

(7) relocate the column forming apparatus to a second column location, and repeat the cavity and column forming procedure as described in (2) through (6) to complete at least said second column of material in soil; and (8) repeat said column forming procedure as many times as desired until said material in said hopper is depleted, and replenishing and repressurizing said hopper as needed to repeat forming a sequence of said columns in said soil.

10. In reducing the cost of installing a succession of at least two columns of granular material to a desired depth in soil, the improvement in the method of installation, comprising:

(1) penetrating soil with an elongated hollow shaft to define a cavity in said soil to a required depth at a location for a first column;

(2) mounting a hopper having an interior volume to contain material to form at least two columns and an outlet conjointly with said hollow shaft in a manner forming a flow path from said hopper into and through said hollow shaft;

(3) providing to said hopper interior a volume of said material to form at least two said columns;

(4) withdrawing said hollow shaft from said soil to progressively form a first cavity in said soil;

(5) applying fluid pressure to said material and said hopper interior to cause said material to flow through said flow path into said cavity substantially as said cavity is formed to install a first column of material in said soil;

(6) closing a valve to avoid flow of the remainder of said material and said fluid pressure from said hopper through said flow path after said first column is formed with said material;

(7) relocating said hollow shaft and said hopper containing the remainder of said material under said fluid pressure to a second location to form a second cavity to install a second column;

(8) penetrating said soil with said elongated hollow shaft to define said second cavity to the desired depth for said second column;

(9) withdrawing said hollow shaft from said soil to form said second cavity in said soil to said desired depth;

(10) causing said valve to permit said material and said fluid to flow through said flow path into said second cavity substantially as said cavity is formed to complete said second column of material in said soil;

(11) repeating aforesaid steps (1) through (6) and (7) through (10) to continue formation of said columns in said soil in a sequence of at least two before replenishing said material in said hopper.

11. The method of claim 9 and claim 10 wherein the material is sand used to form sand drains to expedite the settlement of compressible soils.

* * * * *